US009260227B2

(12) United States Patent
Kawamura et al.

(10) Patent No.: US 9,260,227 B2
(45) Date of Patent: Feb. 16, 2016

(54) PLASTIC-MADE CAP FOR VIAL

(75) Inventors: Hideaki Kawamura, Tokyo (JP); Hiroshi Togashi, Tokyo (JP)

(73) Assignee: DAIKYO SEIKO, LTD., Tokyo (JP)

( * ) Notice: Subject to any disclaimer, the term of this patent is extended or adjusted under 35 U.S.C. 154(b) by 1209 days.

(21) Appl. No.: 12/273,072

(22) Filed: Nov. 18, 2008

(65) Prior Publication Data

US 2009/0145876 A1 Jun. 11, 2009

(30) Foreign Application Priority Data

Dec. 10, 2007 (JP) ..... 2007-318691

(51) Int. Cl.

| | |
|---|---|
| ***B65D 41/00*** | (2006.01) |
| ***B65D 41/62*** | (2006.01) |
| ***B65D 51/18*** | (2006.01) |
| ***A61J 1/00*** | (2006.01) |
| ***A61J 1/03*** | (2006.01) |
| ***B65D 55/02*** | (2006.01) |
| ***B65D 41/16*** | (2006.01) |
| ***B65D 41/18*** | (2006.01) |

(Continued)

(52) U.S. Cl.

CPC ..... *B65D 51/002* (2013.01); *B65D 51/18* (2013.01); *A61J 1/14* (2013.01); *B65D 2251/009* (2013.01); *B65D 2251/0015* (2013.01); *B65D 2251/0056* (2013.01)

(58) Field of Classification Search

CPC ..... B65D 41/28; B65D 51/20; B65D 51/002; A61J 2001/1425

USPC ..... 215/305, 277, 202, 211, 224; 220/254.1, 254.2, 254.7, 780

See application file for complete search history.

(56) References Cited

U.S. PATENT DOCUMENTS 3,075,627 A * 1/1963 Kuckhoff ..... 400/208
4,416,661 A 11/1983 Norman et al.

(Continued)

FOREIGN PATENT DOCUMENTS

DE 102004017871 11/2004
ES 2261104 11/2006

(Continued)

OTHER PUBLICATIONS

Search Report for EP Patent App. No. 08020321.9 (Feb. 9, 2009).

(Continued)

*Primary Examiner* — Fenn Mathew
*Assistant Examiner* — Andrew T Kirsch
(74) *Attorney, Agent, or Firm* — Hamre, Schumann, Mueller & Larson, P.C.

(57) ABSTRACT

A plastic-made cap for a vial having a lip, the cap being useful as a separation-preventing cap for a plug that seals up an opening of the vial, includes a top wall portion having an outer circumference and centrally defining an opening, and a cylindrical skirt portion extending downwardly from the outer circumference of the top wall portion and being open at its lower end. The skirt portion has an inner diameter (a) greater than an outer diameter (b) of the lip of the vial. The skirt portion is provided on its inner wall with plural ribs formed in a direction perpendicular to the top wall portion. The plural ribs are arranged in pairs at equal angular intervals between the respective pairs of ribs. Further, engagement claws are arranged between the respective pairs of ribs such that the engagement claws can be brought into engagement with an underside of the lip of the vial.

17 Claims, 10 Drawing Sheets

(51) Int. Cl.

| | |
|---|---|
| ***B65D 41/28*** | (2006.01) |
| ***B65D 51/20*** | (2006.01) |
| ***B65D 51/00*** | (2006.01) |
| *A61J 1/14* | (2006.01) |

(56) References Cited

U.S. PATENT DOCUMENTS

| | | | | | |
|---|---|---|---|---|---|
| 5,678,718 | A | * | 10/1997 | Morris et al. | 220/254.1 |
| 5,718,348 | A | | 2/1998 | Manera | |
| 5,772,652 | A | * | 6/1998 | Zielinski | 604/411 |
| 5,901,866 | A | | 5/1999 | Storar | |
| 6,070,748 | A | | 6/2000 | Storar | |
| 7,097,057 | B2 | * | 8/2006 | Classens | 215/247 |
| 2004/0217081 | A1 | | 11/2004 | Konrad | |

FOREIGN PATENT DOCUMENTS

| | | | |
|---|---|---|---|
| JP | 10-95451 | A | 4/1998 |
| JP | 2007282891 | | 11/2007 |

OTHER PUBLICATIONS

Japanese Office Action for related Japanese Patent Application No. 2007-318691 dated Jun. 26, 2012.

* cited by examiner

PLASTIC-MADE CAP FOR VIAL

CROSS-REFERENCE TO RELATED APPLICATION

This application claims the priority of Japanese Patent Application 2007-318691 filed Dec. 10, 2007, which is incorporated herein by reference.

FIELD OF THE INVENTION

This invention relates to a plastic-made cap for a vial, and more specifically to a plastic-made cap for a vial having a lip, said plastic-made cap being capable of sufficiently holding a plug applied to the vial even when the lip of the vial is somewhat low in dimensional accuracy.

BACKGROUND ART

As storage containers for various medicaments such as drugs, so-called vials have been widely used over years. As these vials, two types are employed, one being glass-made vials and the other plastic-made vials. Of these, the glass-made vials are equipped with very high gas barrier properties compared with the plastic-made vials, and therefore, are used as medicament containers for which high gas barrier properties are required.

After a medicament is stored in such a vial, its mouth is sealed with a plug such as a rubber plug. When the vial is subjected to treatment such as heat sterilization, the plug may slip out of the vial mouth due to a rise in the internal pressure of the vial. It is, therefore, a common practice to fit a cap, which is made of aluminum or a plastic, on the mouth of the vial such that the cap encloses the plug therein and extends onto an underside of a lip of the mouth to keep the plug in close contact with the mouth, to prevent the separation of the plug and to assure the sealing of an interior of the vial (JP-A-2007-282891).

An aluminum-made cap is crimped at a lower part thereof below the lip of the mouth of the vial by making use of its superb deformability, and therefore, is equipped with excellent separation-preventing properties. An aluminum-made cap is, however, accompanied by a problem that fine aluminum particles occur and scatter through its contact with other aluminum-made caps and also by a problem that segregated disposal of aluminum is difficult after its use. There is, accordingly, a tendency to avoid the use of aluminum-made caps in recent years.

A plastic-made cap, on the other hand, is free of such problems of the aluminum-made cap, but due to the lower deformability of a plastic than aluminum, is accompanied by a problem that its engagement with a vial cannot be as tight as that available from an aluminum-made cap. Described specifically, when an aluminum-made cap is crimped at a lower part thereof on a lip of a vial mouth, the lower part is caused to deform along the lip and is readily crimped by making use of its excellent deformability. In the case of a plastic-made cap, on the other hand, the cap is provided with engagement claws, and upon capping, these claws are brought into engagement with a lip of a vial mouth. The above-described problem of the plastic-made cap can be attributed to the above-mentioned difference in structure.

The plastic-made cap easily separates from the vial because the engagement between the vial and the plastic-made cap is not tight as described above. This problem can be solved if the engagement between the vial and the cap is made tight. However, the capping itself becomes harder as an attempt is made to establish tighter engagement. As appreciated from the foregoing, the cap and the vial are both required to have high dimensional accuracy. If a cap and a vial are both made of plastics, their dimensional accuracy can be improved to certain extent because they can be molded into predetermined shapes while taking into consideration even shrinkage deformations which take place upon cooling.

On the other hand, a glass-made vial has a dimensional error greater by one digit than a plastic-made vial because it is produced while adjusting its shape. No matter how much the dimensional accuracy of a plastic-made cap is improved, its application to a glass-made vial still involves a problem that the separation of the cap can be hardly prevented to sufficient extent. Under these circumstances, extremely high dimensional accuracy is required for both of a glass-made vial and a plastic-made vial to bring the plastic-made cap into tight engagement with the glass-made vial compared with the engagement of an aluminum-made cap. There is, however, a limitation to how much the dimensional accuracy of the glass-made vial can be improved. Even if plastic-made caps are provided with high dimensional accuracy, they are hence accompanied by a problem that, when they are applied to glass-made vials, the percentage of acceptable plastic-made caps is extremely low because of large dimensional errors of the glass-made vials.

SUMMARY OF THE INVENTION

An object of the present invention is, therefore, to provide a plastic-made cap which, even when used for a vial having a large dimensional error like a glass-made vial, to say nothing of a plastic-made vial, can absorb the dimensional error of the glass-made vial to tightly hold a plug, which has been applied to the glass-made vial, on the glass-made vial.

The above-described object can be achieved by the present invention to be described hereinafter. In a preferred first embodiment of the present invention, there is thus provided a plastic-made cap for a vial having a lip, said cap being useful as a separation-preventing cap for a plug that seals up an opening of the vial, comprising:

a top wall portion having an outer circumference and centrally defining an opening, and a cylindrical skirt portion extending downwardly from the outer circumference of the top wall portion and being open at a lower end thereof, wherein the skirt portion has an inner diameter greater than an outer diameter of the lip of the vial, and the skirt portion is provided on an inner wall thereof with at least two ribs formed at an angular interval in a direction perpendicular to the top wall portion such that, upon application of the cap onto the lip with the opening of the vial being sealed with the plug, the ribs can be elastically deformed to facilitate the application of the cap onto the lip and further to prevent separation of the cap from the lip.

In the preferred first embodiment, plural ribs may preferably be arranged in pairs at equal angular intervals between the respective pairs of ribs. Preferably, the at least two plural ribs may each have a height of 0.1 to 3 mm and a width of 0.5 to 5 mm. The skirt portion may preferably have aft inclined portion on the inner wall thereof along the lower end of the skirt portion, and the at least two ribs may preferably be arranged on the inner wall other than the inclined portion.

In the preferred first embodiment, the plastic-made cap may preferably further comprise a cover finger-removably arranged on the top wall portion. The cover may preferably be finger-removably secured on the top wall portion via protuberances. The cover may preferably be provided at an outer circumference thereof with at least one finger stop, and the skirt portion may preferably be provided on an outer wall thereof with at least one shallow groove portion in registration with the at least one finger stop to facilitate finger-removal of the finger-removable cover.

In a preferred second embodiment, the plastic-made cap may further comprise at least two engagement claws formed on the inner wall of the skirt portion at positions between the at least two ribs, respectively, such that the engagement claws can be brought into engagement with an underside of the lip of the vial to assure the prevention of unintentional separation of the cap from the lip. The cap may preferably be provided through the top wall portion with at least two slots formed along the outer circumference of the top wall portion at positions in registration with the engagement claws, respectively, to facilitate formation of the engagement claws. The plastic-made cap may preferably further comprises at least two recessed portions formed on the inner wall of the skirt portion, in registration with the at least two ribs, and between the engagement claws and the slots, respectively, such that the recessed portions can facilitate elastic deformation of the engagement claws toward the inner wall of the skirt portion.

In the preferred second embodiment, plural ribs may preferably be arranged in pairs at equal angular intervals between the respective pairs of ribs, and plural engagement claws are arranged on the inner wall at positions between the respective pairs of ribs such that the engagement claws can be brought into engagement with an underside of the lip of the vial. The cap may preferably be provided through the top wall portion with slots formed along the outer circumference of the top wall portion at positions in registration with the engagement claws, respectively, to facilitate formation of the engagement claws. The plastic-made cap may preferably further comprise plural recessed portions formed on the inner wall of the skirt portion, in registration with the pairs of plural ribs and between the engagement claws and the slots, respectively, such that the recessed portions can facilitate elastic deformation of the engagement claws toward the inner wall of the skirt portion.

In the preferred second embodiment, the plastic-made cap may preferably further comprise a cover finger-removably arranged on the top wall portion. The cover may preferably be finger-removably secured on the top wall portion via protuberances. The cover may preferably be provided at an outer circumference thereof with at least one finger stop, and the skirt portion is provided on an outer wall thereof with at least one shallow groove portion in registration with the at least one finger stop to facilitate finger-removal of the finger-removable cover.

The plastic-made cap according to the present invention can absorb a dimensional error of a vial and can tightly hold the plug that seals up the vial, even when the vial has a large dimensional error like a glass-made vial, to say nothing of the case that the vial is a plastic-made vial.

DETAILED DESCRIPTION OF THE INVENTION AND PREFERRED EMBODIMENTS

Figure 1:
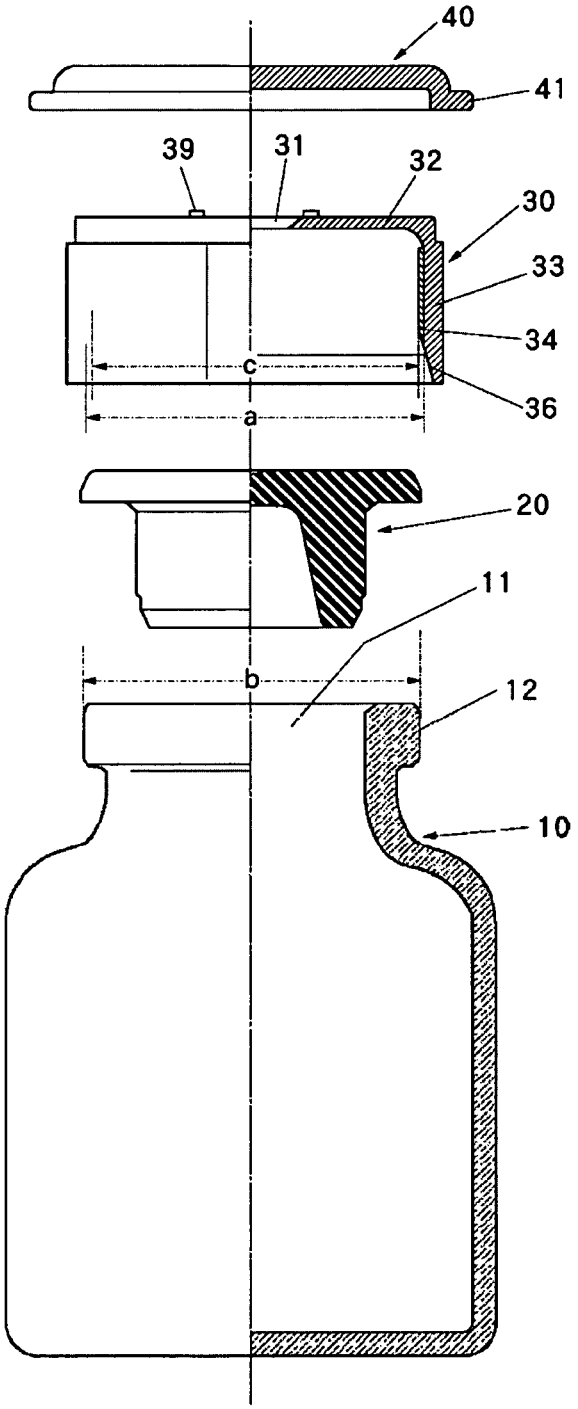
FIG. 1 is an exploded, half cross-sectional, half front view of a vial assembly, which is taken along line I-I of FIG. 3A and illustrates a cap according to a first embodiment of the present invention and a manner of its application.
Figure 2:
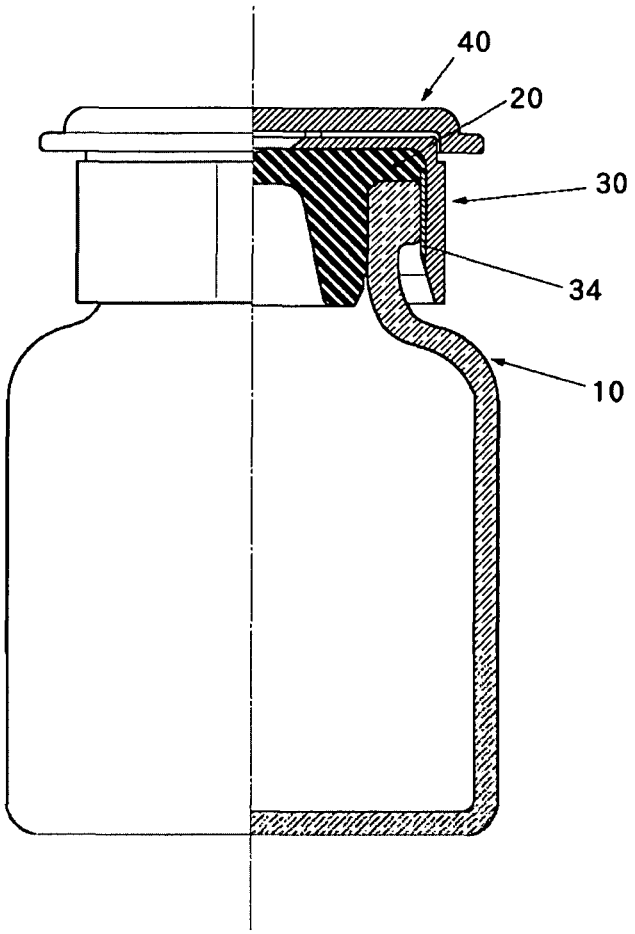
FIG. 2 is a half cross-sectional, half front view of the vial assembly, which is taken along line II-II of FIG. 3A and illustrates the cap according to the first embodiment in its applied position.
Figure 3A:
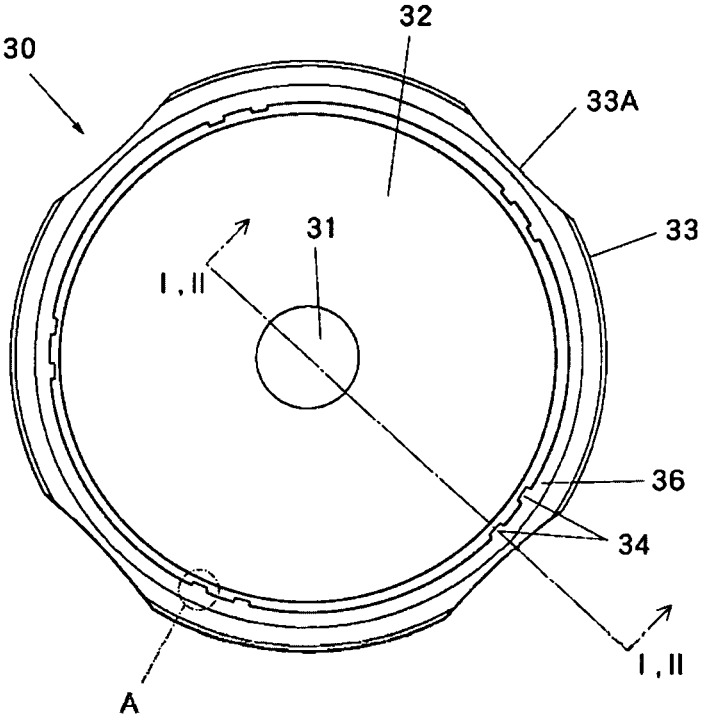
FIG. 3A is a bottom view of the cap of FIG. 1.
Figure 3B:
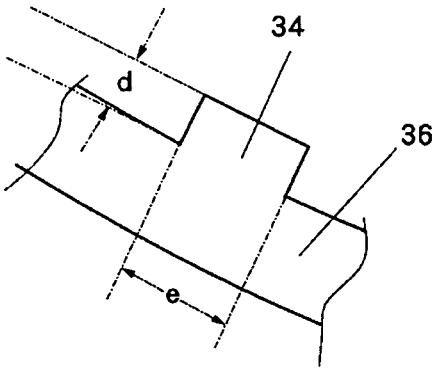
FIG. 3B is an enlarged fragmentary bottom view illustrating on an enlarged scale a part indicated by a circle A in FIG. 3A and showing one of plural ribs, which are arranged on an inner wall of a skirt portion of the cap according to the first embodiment, together with a part of the skirt portion.

The present invention will next be described in further detail with reference to the accompanying drawings showing best modes for practicing the present invention. A plastic-made cap 30 according to the first embodiment of the present invention for a vial 10 is a separation-preventing cap for a plug 20 sealing up an opening 11 of the vial 10, as depicted in FIGS. 1 through 4. The cap 30 is composed a top wall portion 32 and a cylindrical skirt portion 33. The top wall portion 32 centrally defines a circular opening 31, and the skirt portion 33 extends downwardly from an outer circumference of the top wall portion 32 and is open at a lower end thereof. The inner diameter (a) of the skirt portion 33 is set greater than the outer diameter (b) of the lip 12 of the vial 10 (see FIG. 1). On an inner wall of the skirt portion 33, plural ribs 34 are formed in pairs, at equal angular intervals between the respective pairs of ribs, and in a direction perpendicular to the top wall portion 32. It is to be noted that other ribs 34 are omitted in FIG. 1 although such other ribs 34 actually exist on the left side of the ribs 34 as viewed in FIG. 1.

In FIG. 1, numeral 40 in FIG. 1 designates a cover and numeral 41 indicates finger stops 41 arranged at equal angular intervals on an outer circumference of the cover 40. The structures and functions of these cover 40 and finger stops 41 will be described subsequently herein in connection with a cap according to the second embodiment of the present invention. On an outer wall of the skirt portion 33, shallow groove portions 33A are formed in registration with the finger stop 41, respectively. These shallow groove portions 33A are arranged to facilitate the engagement of a finger with any one of the finger stops 41.

The top wall portion 32 of the cap 30 is in the form of a disk, and a circular opening 31 is centrally formed through the top wall portion 32 to permit insertion of a syringe needle or the like therethrough. No particular limitation is imposed on the size of the circular opening 31 insofar as the above-described function can be performed. It is also to be noted that the opening 31 is not limited to the circular shape and may have any other appropriate shape insofar as the above-described function can be performed. An inclined portion 36 is formed on the inner wall of the skirt portion 33 along the lower end of the skirt portion 33 to facilitate the application of the cap 30 onto the vial 10.

Figure 4:
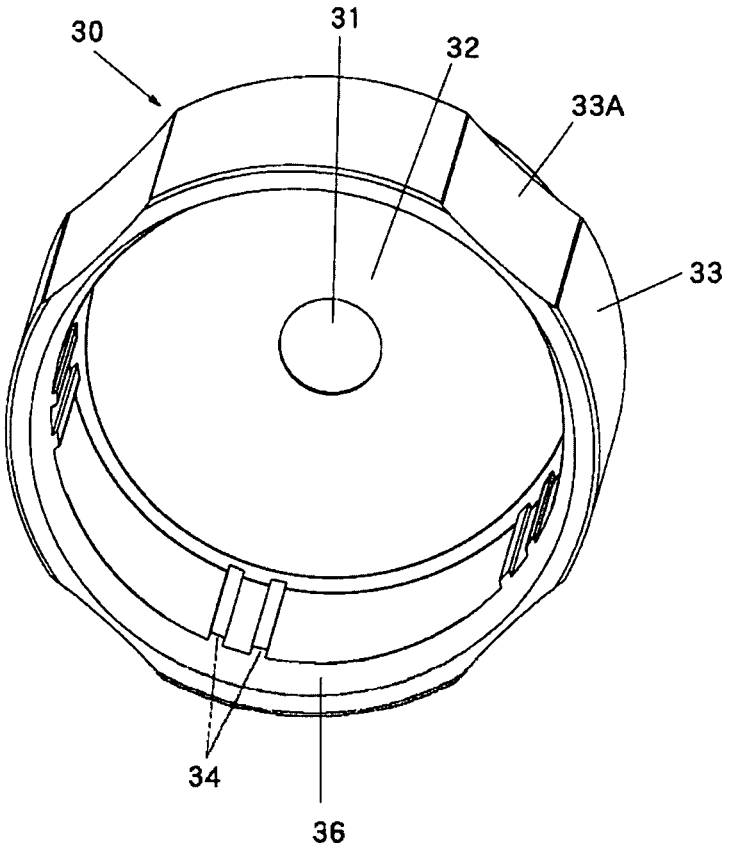
FIG. 4 is a perspective view of the cap of FIG. 1 as seen upward.

As described above, the plural ribs 34 (ten ribs in the illustrated embodiment), which primarily characterize the present invention, are arranged on the inner wall of the skirt portion 33 as shown in FIGS. 1 through 4. More specifically, the paired ribs 34 are arranged as many as five pairs at equal angular intervals between the paired ribs 34 on the inner wall of the skirt portion 33 as shown in FIGS. 3A, 3B and 4. It is, however, not essential to arrange such ribs in pairs. As an alternative, plural ribs may be arranged separately one by one or in combinations of three or more. Irrespective of whether these ribs are arranged separately one by one or in combinations of two or more, they are required to be arranged at at least two positions, preferably at three or more positions, more preferably at four or more positions, with equal angular intervals therebetween.

The ribs 34 has a function that upon application of the cap 30 onto the vial 10, the ribs 34 are brought into contact with an outer circumferential wall of the lip 12 around the opening 11 of the vial 10 to absorb a dimensional error of the lip 12 of the vial 10. Described specifically, the diameter (c) of a circle, which is defined by the top walls of the ribs 34, is set either equal to or slightly smaller than the outer diameter (b) of the lip 12 of the vial 10 (FIG. 1). The outer circumferential wall of the lip 12 are, therefore, assured to come into contact with the top walls of the ribs 34 even if the lip 12 of the vial 10 has a dimensional error, for example, the outer diameter (b) of the lip 12 is either equal to or somewhat smaller than the circle defined by the top walls of the ribs 34 on the inner wall of the cylindrical skirt portion 33. The ribs 34, hence, serve to minimize looseness of the cap 30 when the cap 30 is applied to the vial 10. Further, when the outer diameter (b) of the lip 12 is greater than the above-described inner diameter (c), the progressive application of the cap 30 onto the lip 12 presses the ribs 34 against the lip 12 so that the ribs 34 are elastically deformed to come into close contact with the outer circumferential wall of the lip 12. It is, therefore, possible to avoid a capping failure. The ribs 34 broaden the tolerance of dimensional errors between the lip 12 of the vial 30 and the cap 30, and further, decrease the possibility of separation of the cap 30 from the lip 12 while retaining the good capping performance of the cap 30.

In general, the dimensional error of the lip 12 of the vial 10 does not occur evenly along the entire outer circumference of the lip 12. Even with the same vial, its direction (plus/minus) and extent (magnitude) thus differ depending on the location where the measurement is made. Even in such as case as mentioned above, the cap 30 according to the present invention can tolerate the maximum point of the outer diameter (b) of the lip 12 provided that the maximum point is positioned between one of the paired ribs 34 and their adjacent paired ribs 34. Concerning the minimum point of the outer diameter (b) of the lip 12, on the other hand, the cap 30 according to the present invention can also reduce the looseness of the cap 30 applied on the lip 12 provided that the minimum point is positioned between one of the paired ribs 34 and their adjacent paired ribs 34.

The ribs 34 are arranged in the direction perpendicular to the top wall portion 32 on the inner surface of the skirt portion 33 at the area other than the inclined portion 36. No particular limitation is imposed on the lengths or widths of the ribs 34 insofar as the ribs 34 are located opposite the outer circumferential wall of the lip 12 of the vial 10. The top walls of the ribs 34 may be planar or may be angled. The height (d) and width (e) (see the enlarged fragmentary bottom view of FIG. 3B) of each rib 34 vary depending on the dimensions of a vial on which the cap 30 according to the present invention is applied. In general, however, the height (d) may preferably range from 0.1 to 3 mm or so and the width (e) may preferably range from 0.5 to 5 mm or so. An excessively small height (d) leads to a reduction in the absorbability of a dimensional error of a vial, while an unduly large height (d) provides the cap 30 with an unnecessarily large outer diameter so that the cap 30 has higher possibility of separation. An excessively large total volume of each rib 34 requires large force for the above-described elastic deformation upon fitting the cap 30 so that the cap 30 may not be applied with ease. An unduly small total volume of each rib 34, on the other hand, results in easy deformation of the rib 34, which connects the vial 10 and the cap 30 with each other, under external force so that the cap 30 is prone to separation. It is, therefore, preferred to change the shape of each rib 34 within the above-described height (d) and width (e) ranges depending on the size of the vial 10 on which the cap 30 is applied.

A cap 50 according to the second embodiment of the present invention will next be described with reference to FIGS. 5 through 9. Backwardly-extending engagement claws 55 are arranged on an inner wall of a skirt portion 53 of the cap 50. It is to be noted that such engagement claws may take any other appropriate shape insofar as they can engage the lip 12 as will be described subsequently herein. Except for these engagement claws 55 and arcuate slots 58 to be described subsequently herein, the construction and manner of use of the cap 50 according to the second embodiment are substantially the same as those of the cap 30 according to the first embodiment. It is to be noted that other engagement claws 55 and adjacent paired ribs similar to the paired ribs 34 in the first embodiment are omitted in FIG. 5 although such other engagement claws 55 and paired ribs 54 actually exist on the left side of the engagement claw 55 as viewed in FIG. 5.

Upon fitting the cap 50 onto the vial 10, these engagement claws 55 progressively undergo elastic deformation outward in the radial direction as the cap 50 is pressed downward. In a downwardly pressed position, the engagement claws 55 are kept in engagement with an underside of the lip 12 and serve to prevent separation of the cap 50. The engagement claws 55 are formed one by one between the respective paired ribs 54, that is, as many as five in total (see FIGS. 7 and 8). Like the above-described ribs 54, no particular limitation is imposed on the number of the engagement claws 55. It is, however, preferred to arrange at least two engagement claws. The arcuate slots 58 are arranged through the top wall portion 52, at equal angular intervals, along the outer circumference of the top wall portion 52, and in registration with the respective engagement claws 55. These arcuate slots 58 were used upon formation of the engagement claws 55. No particular limitation is imposed on the shapes of such slots insofar as the formation of the engagement claws 55 is feasible.

Figure 5:
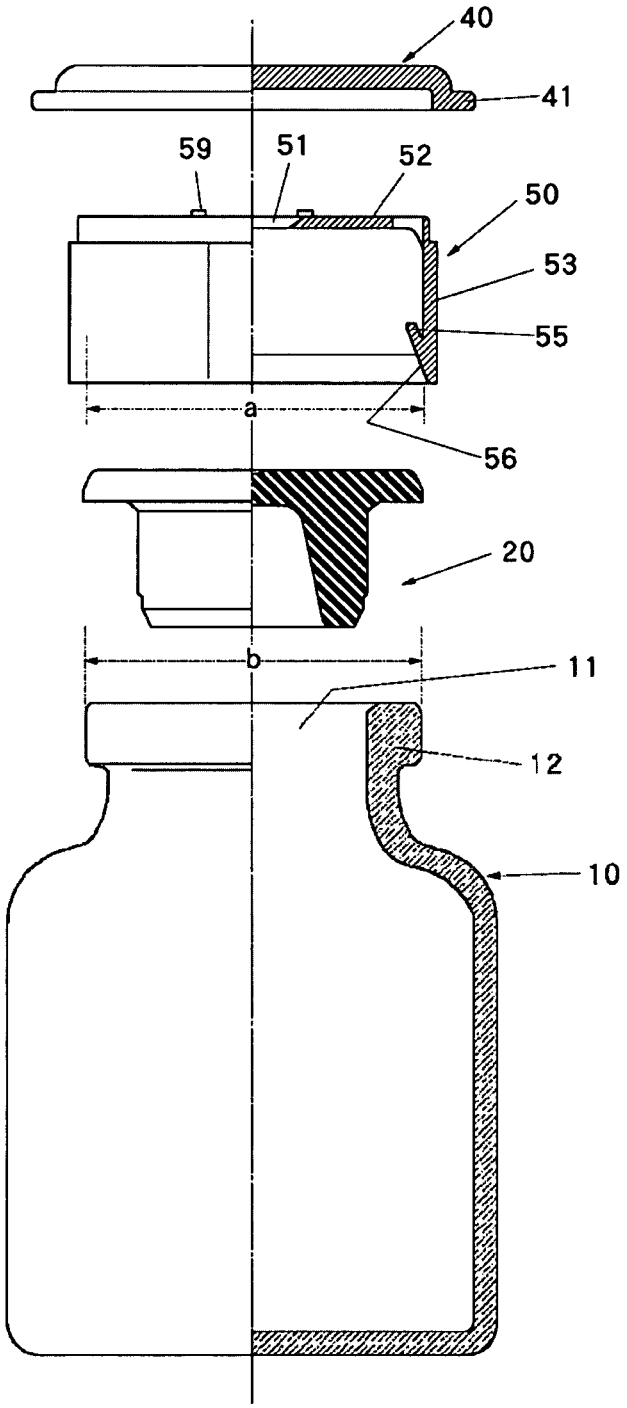
FIG. 5 is an exploded, half cross-sectional, half front view of a vial assembly, which is taken along line V-V of FIG. 7 and illustrates a cap according to a second embodiment of the present invention and a manner of its application.
Figure 7:
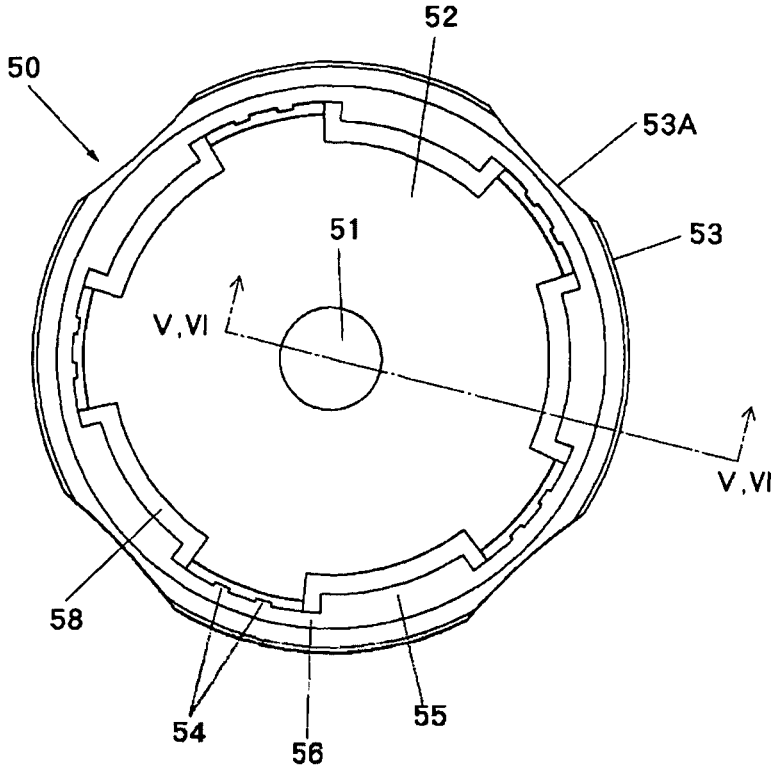
FIG. 7 is a bottom view of the cap of FIG. 5.
Figure 8:
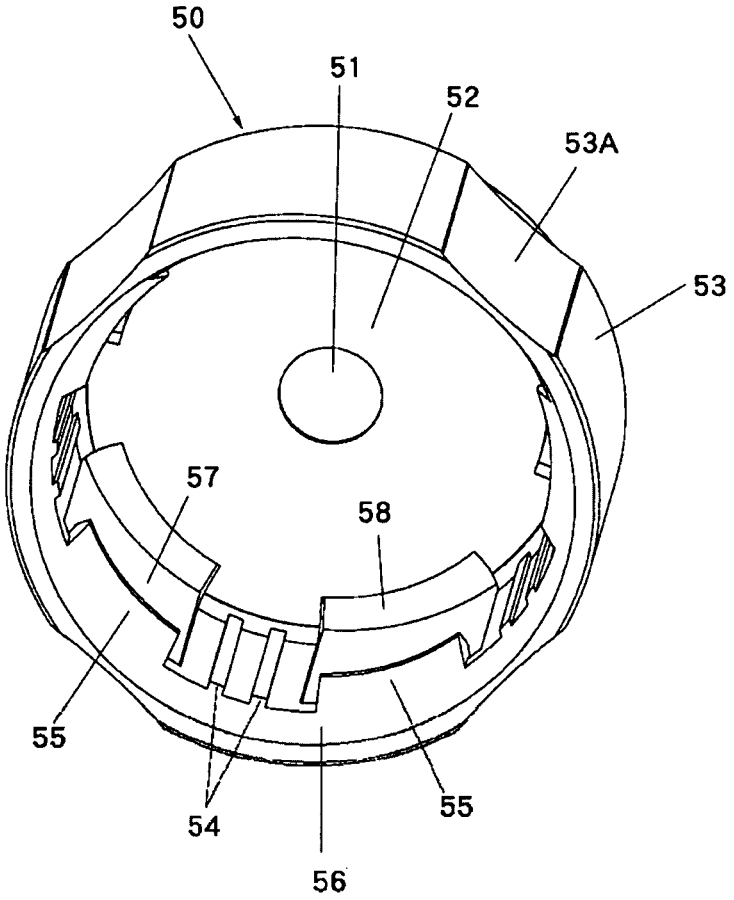
FIG. 8 is a perspective view of the cap of FIG. 5 as seen upward.

Numeral 56 in FIGS. 5, 7 and 8 indicates an inclined portion similar to the inclined portion 36 in the first embodiment (see FIGS. 1, 3A, 3B and 4). On the inner wall of the skirt portion 53 at areas on sides inner than the engagement claws 55, recessed portions 57 are formed to facilitate the elastic deformation of the engagement claws 55 outward in the radial direction (toward the inner wall of the skirt portion 53). It is, however, to be noted that these recessed portions 57 are not essential for the second embodiment of the present invention. The engagement claws 55 themselves are known to the public, and no particular limitation is imposed on the shapes or the like of the engagement claws 55. On an outer wall of the skirt portion 53, shallow groove portions 53A are formed in registration with the finger stop 41. These shallow groove portions 53A are arranged to facilitate the engagement of a finger with any one of the finger stop 41.

Figure 9:
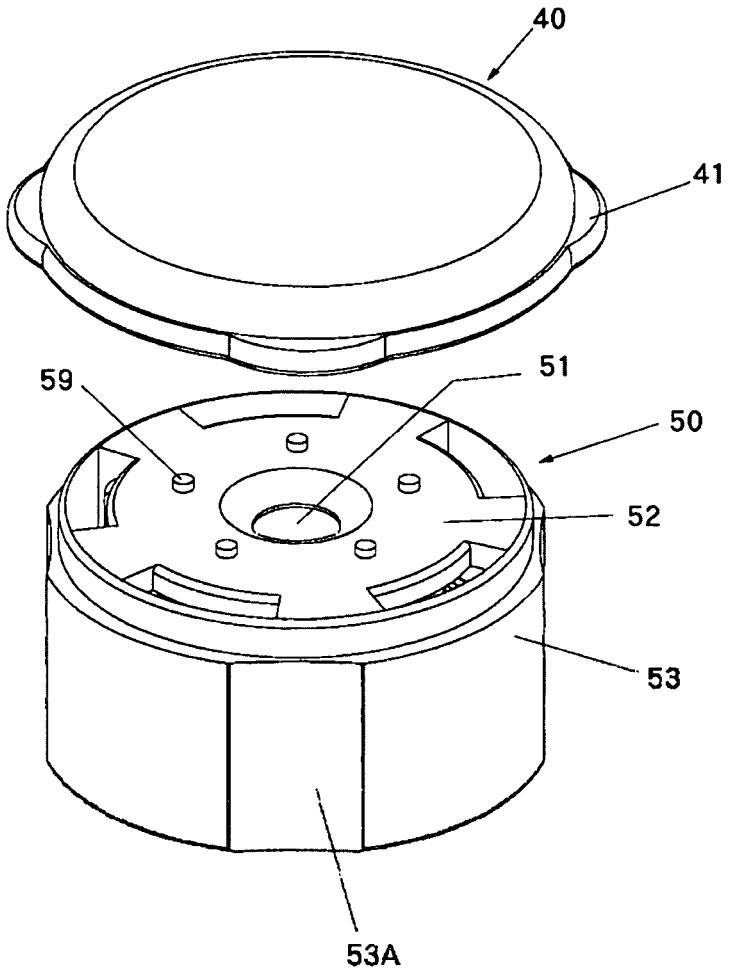
FIG. 9 is an exploded perspective view of the cap and a cover of FIG. 5.

As illustrated in FIG. 9, the cap 50 according to the second embodiment of the present invention and the cover 40 are separately molded with a plastic such as, for example, polypropylene. Upon molding the cap 50, disk-shaped protuberances 59 which are planar at the tops thereof are molded at the same time at several points (five points in the illustrated second embodiment) on the top wall portion 52. Using their tops, the cover 40 is fixed to the cap 50 by an adhesive, fusion bonding or the like. This cover 40 is not essential in the present invention. It is, however, preferred to arrange the cover 40 for preventing dust and the like from adhering inside through a circular opening 51 and the arcuate slots 58. One or more finger stops 41 (four finger stops 41 in the illustrated second embodiment) are formed on the cover 40 such that the cover 40 can be easily removed as needed by bringing a finger into engagement with desired one of the finger stops 41.

With reference to FIGS. 5 through 9, a description will hereinafter be made of the manner of use of the cap 50 according to the second embodiment of the present invention. It is to be noted that the manner of use of the cap 30 according to the first embodiment of the present invention is similar to that of the cap 50 except for the omission of the backwardly-extending engagement claws 55 and a description of the manner of use of the cap 30 is therefore omitted herein. In FIGS. 5 and 9, the cover 40 and the cap 50 are shown apart from each other. Actually, however, the cover 40 and the cap 50 are integral with each other as described above.

Figure 6:
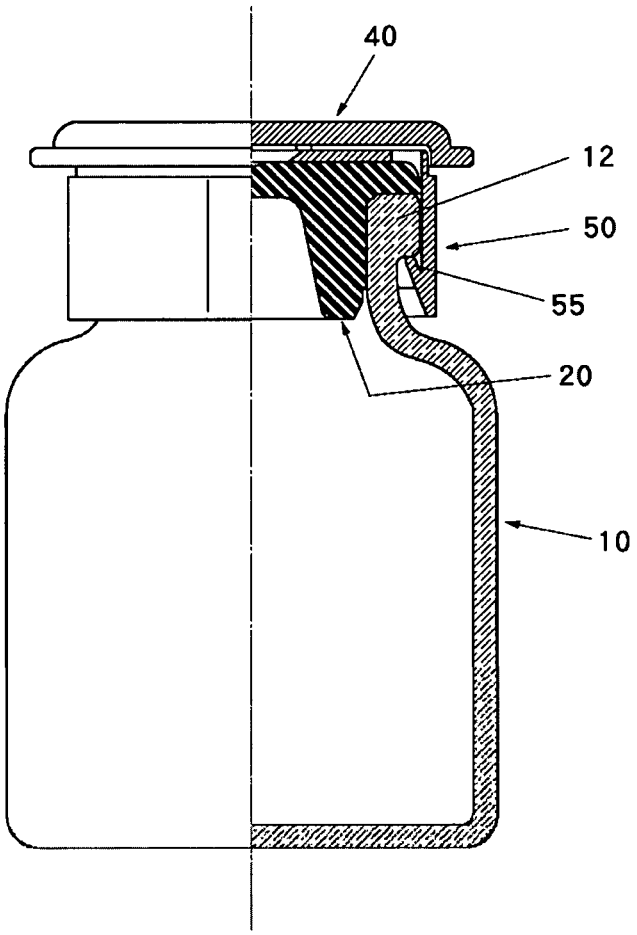
FIG. 6 is a half cross-sectional, half front view of the vial assembly, which is taken along line VI-VI of FIG. 7 and illustrates the cap according to the second embodiment in its applied position.

After the vial 10 is filled with a desired medicament, the plug 20 such as a rubber plug is fitted in the opening 11 of the vial 10 to seal the vial 10. In this state, there is a potential risk that the plug 20 may separate due to a rise in the internal pressure of the vial during handling of the vial 10, for example, during heat sterilization or the like. When the cap 50 is being fitted onto the vial 10 sealed with the plug 20 as depicted in FIG. 6, the engagement claws 55 are caused to move downwardly as the cap 50 moves downwardly, so that the engagement claws 55 undergo elastic deformation and are pressed toward the skirt portion 53 while being kept in contact with the outer circumferential wall of the lip 12. As soon as free ends of the engagement claws 55 pass beyond the outer circumferential wall of the lip 12, the engagement claws 55 return to the original positions and come to engagement with the underside of the lip 12. As a result, the plug 20 and the cap 50 are fixedly secured on the vial 10.

Upon fitting the cap 50, the diameter (c) (see FIG. 1) of a circle defined by the top walls of the ribs 54 on the skirt portion 53 should ideally be either equal to or slightly smaller than the outer diameter (b) of the lip 12 of the vial 10 in general (see FIG. 5). In reality, however, the vial 10, especially when it is made of glass, unavoidably has a dimensional error as described above. A situation may, therefore, arise that, no matter how much the dimensional accuracy of the cap 50 is increased, the cap 50 cannot be adapted to the vial 10 (because it is prone to separation or the capping is difficult).

In the second embodiment of the present invention, the dimensional error of the vial 10 has been taken into consideration. Described specifically, the inner diameter (a) of the skirt portion 53 is set greater by the dimensional error, which is expected on the vial 10, than the outer diameter (b) of the lip 12 of the vial 10. In addition, the above-described ribs 54 are arranged on the inner wall of the skirt portion 53, and the diameter (c) of the circle defined by the top walls of the ribs 54 is set smaller by the expected dimensional error than the inner diameter (a) of the skirt portion 53. When the dimension of the lip 12 of the vial 10 varies up, this dimensional error can, therefore, be absorbed through the elastic deformation of the ribs 54. Even when the dimension of the lip 12 of the vial 10 varies down, on the other hand, the outer circumferential wall of the lip 12 comes into contact with the top walls of the ribs 54. When the lip 12 of the vial 10 has the predetermined dimension, the outer circumferential wall of the lip 12 comes into contact with the ribs 54 while causing the top walls of the ribs 54 to undergo elastic deformation to some extent. In each of these cases, the contact between the skirt portion 53 and the outer circumferential wall of the lip 12 upon fitting takes place at the ribs 54 the areas of contact of which are small, and therefore, the cap 50 does not require large force for its application and can show excellent capping performance.

Even when the cap 50 according to the second embodiment of the present invention is applied to the vial 10 with the lip 12 the dimension of which is liable to a variation as in a glass-made vial, the cap 50 can absorb the dimensional error of the vial 10 so that no large force is required upon fitting the cap 50. Moreover, as the inner wall of the skirt portion 53 and the outer circumferential wall of the lip 12 always remain in contact with each other, the cap 50 does not come loose so that the separation of the cap 50 can be prevented. It is, therefore, possible to pronouncedly improve the percentage of acceptable caps in use. It is to be noted that the cap according to the present invention is useful not only for a glass-made vial but also for a plastic-made vial.

The present invention will next be described more specifically based on Examples and Comparative Examples.

Example 1

Polypropylene-made caps having the structure of the second embodiment of the present invention (the configurations of FIG. 8) were produced for glass-made vials with lips having an outer diameter (b) of 32 mm. The caps had the following dimensions:

Inner diameter (a): 32.25 mm
Diameter (c) of a circle defined by the top walls of the ribs 54 (see FIG. 1): 31.75 mm
Height (d) of each rib 54 (see FIG. 3B): 0.25 mm
Width (e) of each rib 54 (see FIG. 3B): 0.5 mm

Comparative Examples 1 & 2

Caps of the same structure and dimensions as in Example 1 except that the ribs 54 were not arranged inside the caps and the dimension of the inner diameter (a) of each cap was changed to 32.25 mm were produced as Comparative Example 1. Caps of the same structure and dimensions as in Example 1 except that the dimension of the inner diameter (a) of each cap was changed to 31.75 mm were produced as Comparative Example 2.

Capping Pressure Test

The samples (caps) of Example 1, Comparative Example 1 and Comparative Example 2 were used as many as ten (10) per example. For the caps of the respective examples, the same glass-made vials (ten vials in total) were used. With respect to the caps of each example, rubber plugs made of chlorinated butyl rubber were applied to the respective vials and the caps were then applied to determine the maximum values of capping pressures needed for their applications. For the measurement of the capping pressures, "AUTOGRAPH AGS-H" (trade name, manufactured by Shimadzu Corporation) was used, and the test speed was set at 500 mm/min. It is to be noted that, whenever the capping pressure exceeded 500 N in the course of the test, the test was stopped for the sake of assurance of safety and was determined to be "a capping failure". The results of the test are shown in Table 1. It is appreciated from Table 1 that with the caps of Example 1, no capping failure took place and the capping pressure was 436 N on average. It is also envisaged from Table 1 that with the caps of Comparative Example 1, no capping failure took place and the capping pressure was 345 N on average and was generally lower than that for the caps of Example 1. It is also understood from Table 1 that with the caps of Comparative Example 2, a capping failure took place on four of them and the capping pressure was 470 N on average, that is, the highest.

Separation Test

The vials capped with the caps of Example 1, Comparative Example 1 and Comparative Example 2 in the capping pressure test (ten vials in the case of the caps of Example 1 and the caps of Comparative Example 1, and only six vials successfully capped in the case of the caps of Comparative Example 2) were placed in an autoclave ("HICLAVE HV-25", trade name; manufactured by Hirayama Manufacturing Corporation) separately depending on the example. The capped vials were held at 121° C. for 60 min, and each vial was checked for the separation of the cap. The test results are also shown in Table 1. From the results shown in Table 1, no separation was confirmed with respect to the caps of Example 1. Concerning the caps of Comparative Example 1, separation was confirmed with three of them. As to the caps of Comparative Example 2, no separation was confirmed.

TABLE 1

| | Example 1 | | Comp. Ex. 1 | | Comp. Ex. 2 | |
|---|---|---|---|---|---|---|
| Sample No. | Capping pressure (N) | Separation | Capping pressure (N) | Separation | Capping pressure (N) | Separation |
| 1 | 418 | None | 333 | Separated | 456 | None |
| 2 | 458 | None | 352 | None | — | — |
| 3 | 435 | None | 346 | None | 484 | None |
| 4 | 426 | None | 338 | None | 488 | None |
| 5 | 419 | None | 324 | Separated | 461 | None |
| 6 | 462 | None | 372 | None | — | — |
| 7 | 443 | None | 359 | None | — | — |
| 8 | 425 | None | 360 | None | 472 | None |
| 9 | 411 | None | 326 | Separated | 459 | None |
| 10 | 458 | None | 337 | None | — | — |
| Average | 436 | 0/10 | 345 | 3/10 | 470 | 4/10* |

*"4" indicates the number of samples not subjected to the separation test as they failed to cap.

The invention claimed is:

1. A plastic-made cap and a vial having a lip that has a circular outer circumference being a continuous circular shape and forms a rim surrounding an opening of the vial, the cap comprising:

a top wall portion having an outer circumference and centrally defining an opening; and a cylindrical skirt portion extending downwardly from said outer circumference of said top wall portion and being open at a lower end thereof, wherein said skirt portion has an inner diameter (a) greater than an outer diameter (b) of said lip of said vial, said skirt portion comprises on an inner wall thereof at least two elastically deformable ribs that are formed at an angular interval in a direction perpendicular to said top wall portion and are designed to contact an outer circumference of the lip of the vial, a diameter (c) of a circle defined by top walls of the ribs is either equal to or smaller than the outer diameter (b) of the lip of the vial, wherein the top walls of the ribs are surfaces facing an inner space of the cap surrounded by the skirt portion and are to contact with a side wall of the lip of the vial, and wherein the cap prevents separation of a plug that seals the opening of the vial when the cap is placed on the vial that has the lip that has the circular outer circumference as a continuous circular shape and forms the rim surrounding the opening of the vial and is sealed with the plug in a sealing state of the vial, in which an upper surface of the lip of the vial contacts a lower surface of the plug and the side wall of the lip of the vial contacts the ribs of the skirt portion of the cap, and wherein, when the side wall of the lip of the vial, which is an outer circumferential wall of the lip of the vial, has a first dimensional error, which is an error having a larger outer diameter (b) of the outer circumferential wall than a designed diameter (b) thereof, the ribs elastically deform by pressure of the top walls of the ribs against the outer circumferential wall of the lip, and thereby the ribs absorb the first dimensional error in the outer diameter (b) of the outer circumferential wall of the lip of the vial in the sealing state of the vial, and when the outer circumferential wall of the lip of the vial has no first dimensional error in the outer diameter (b), (i) the top walls of the ribs contact the outer circumferential wall of the lip without elastic deformation or (ii) the top walls of the ribs contact with elastic deformation in a degree less than the elastic deformation occurring when the outer circumferential wall of the lip of the vial has the first dimensional error in the outer diameter (b), in the sealing state of the vial.

2. The plastic-made cap and vial according to claim 1, wherein the plural ribs are arranged in pairs at equal angular intervals between the respective pairs of the ribs.

3. The plastic-made cap and vial according to claim 1, wherein said at least two ribs each have a height from 0.1 to 3 mm and a width from 0.5 to 5 mm.

4. The plastic-made cap and vial according to claim 1, wherein said skirt portion has an inclined portion on said inner wall thereof along said lower end of said skirt portion, and said at least two ribs are arranged on said inner wall other than said inclined portion.

5. The plastic-made cap and vial according to claim 1, further comprising a cover finger-removably arranged on said top wall portion.

6. The plastic-made cap and vial according to claim 5, wherein said cover is finger-removably secured on said top wall portion via protuberances.

7. The plastic-made cap and vial according to claim 5, wherein said cover comprises at an outer circumference thereof at least one finger stop, and said skirt portion comprises on an outer wall thereof at least one shallow groove portion in registration with said at least one finger stop that facilitates finger-removal of said finger-removable cover.

8. The plastic-made cap and vial according to claim 1, further comprising at least two engagement claws formed on said inner wall of said skirt portion at positions between said at least two ribs, respectively, such that said engagement claws are designed to engage with an underside of said lip of said vial and prevent unintentional separation of said cap from said lip.

9. The plastic-made cap and vial according to claim 8, wherein said cap is provided through said top wall portion with at least two slots formed along said outer circumference of said top wall portion at positions in registration with said engagement claws, respectively, wherein the slots facilitate formation of said engagement claws.

10. The plastic-made cap and vial according to claim 9, further comprising at least two recessed portions formed on said inner wall of said skirt portion, in registration with said at least two ribs, and between said engagement claws and said slots, respectively, such that said recessed portions are designed to facilitate elastic deformation of said engagement claws toward said inner wall of said skirt portion.

11. The plastic-made cap and vial according to claim 8, wherein the plural ribs are arranged in pairs at equal angular intervals between the respective pairs of ribs, and the plural engagement claws are arranged on said inner wall at positions between said respective pairs of the ribs.

12. The plastic-made cap and vial according to claim 11, wherein said cap is provided through said top wall portion with slots formed along said outer circumference of said top wall portion at positions in registration with said engagement claws, respectively, wherein the slots facilitate formation of said engagement claws.

13. The plastic-made cap and vial according to claim 12, further comprising plural recessed portions formed on said inner wall of said skirt portion, in registration with said pairs of the plural ribs and between said engagement claws and said slots, respectively, such that said recessed portions are designed to facilitate elastic deformation of said engagement claws toward said inner wall of said skirt portion.

14. The plastic-made cap and vial according to claim 8, further comprising a cover finger-removably arranged on said top wall portion.

15. The plastic-made cap and vial according to claim 14, wherein said cover is finger-removably secured on said top wall portion via protuberances.

16. The plastic-made cap and vial according to claim 14, wherein said cover comprises at an outer circumference thereof at least one finger stop, and said skirt portion comprises on an outer wall thereof at least one shallow groove portion in registration with said at least one finger stop that facilitates finger-removal of said finger-removable cover.

17. The plastic-made cap and vial according to claim 1, wherein the inner diameter (a) of the skirt portion of the cap is greater than a designed outer diameter (b) of the outer circumferential wall of the lip of the vial by an expected amount of the first dimensional error in the outer diameter (b), and the diameter (c) of the circle defined by the top walls of the ribs is smaller than the designed outer diameter (b) of the outer circumferential wall of the lip of the vial by an expected amount of a second dimensional error in the outer diameter (b) as having a smaller outer diameter (b) of the outer circumferential wall than the designed outer diameter (b) thereof.

* * * * *